United States Patent [19]

Vasilantone

[11] 3,943,849

[45] Mar. 16, 1976

[54] SQUEEGEE WITH SWEEP-MOVEMENT CAPABILITY

[76] Inventor: Michael Vasilantone, 147 E. First Ave., Roselle, N.J. 07203

[22] Filed: Sept. 13, 1973

[21] Appl. No.: 396,778

[52] U.S. Cl. ..... 101/123; 101/123
[51] Int. Cl.[2] ..... B41F 15/02; B41F 15/42
[58] Field of Search ..... 101/114, 115, 123, 124, 101/129

[56] References Cited

UNITED STATES PATENTS

| | | | |
|---|---|---|---|
| 2,162,440 | 6/1939 | Masson | 101/123 |
| 2,775,194 | 12/1956 | Dubuit | 101/123 |

FOREIGN PATENTS OR APPLICATIONS

| | | | |
|---|---|---|---|
| 878,492 | 4/1953 | Germany | 101/114 |

OTHER PUBLICATIONS

Colonial Catalog, p. 75, 1970 Edition.
M & M Catalog, No. 1070, pp. 2–4.

*Primary Examiner*—Edgar S. Burr
*Assistant Examiner*—R. E. Suter
*Attorney, Agent, or Firm*—Edward E. Dyson; John J. Byrne

[57] ABSTRACT

A mechanical squeegee apparatus directed for use with and mounted on a stencil screen printing device. The apparatus includes a longitudinal support bar and a lateral support bar which is mounted for movement along the longitudinal bar and which extends transversely thereof and over said screen. A squeegee is mounted on the lateral bar for free movement along its length and for substantially free rotational movement relative to the lateral bar on an axis vertical and perpendicular to that of the lateral bar. The free lateral movement and the substantially free rotational movement allows the squeegee to be used to sweep ink from the side edges of the screen toward the center without the use of an intermediary device such as a hand-held card or scraper.

9 Claims, 4 Drawing Figures

Fig. 2
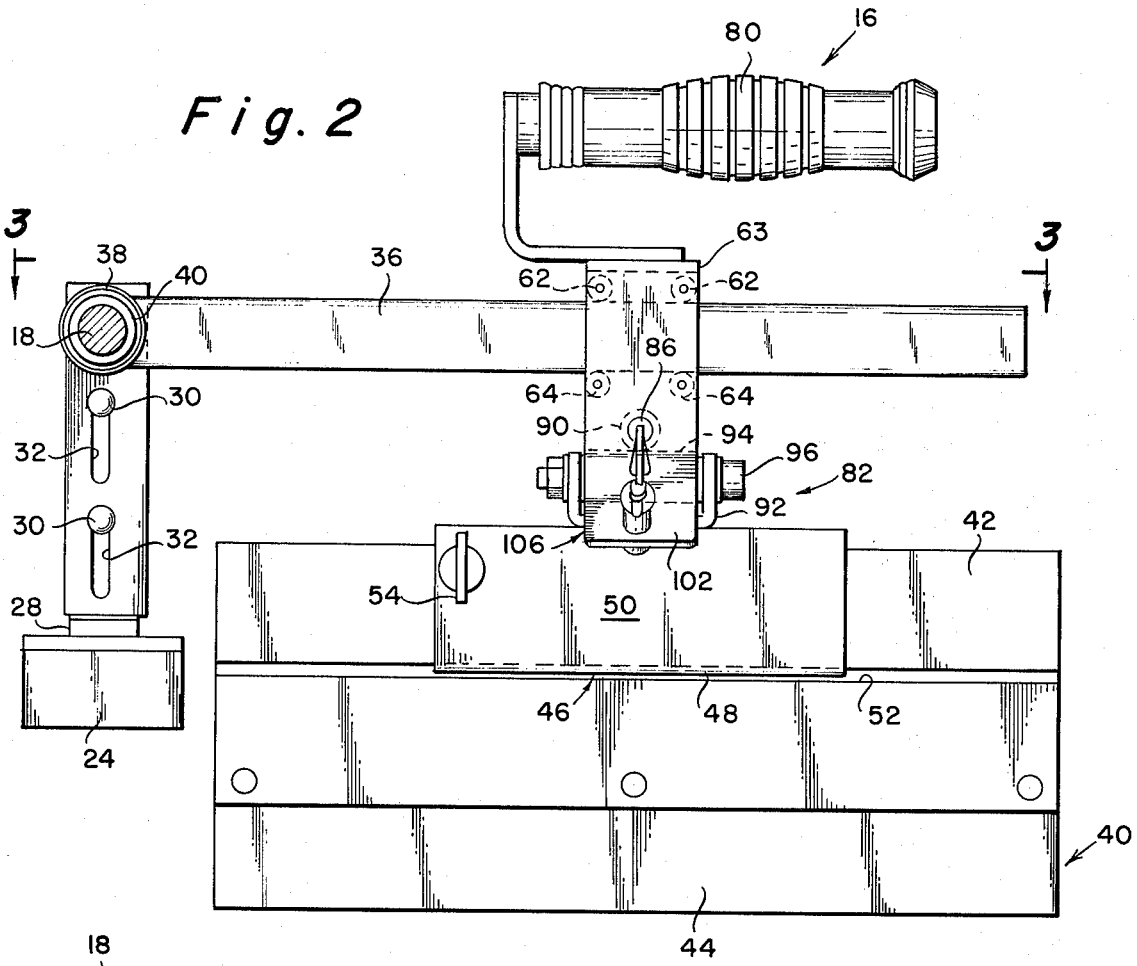
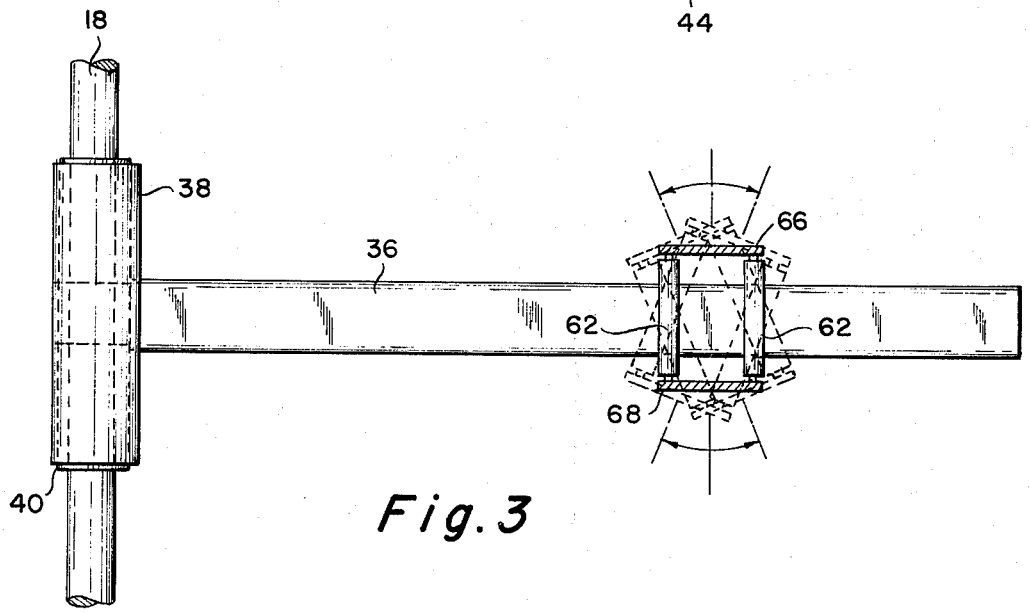
Fig. 3

SQUEEGEE WITH SWEEP-MOVEMENT CAPABILITY

BACKGROUND AND FIELD OF INVENTION

This invention relates to improvements in the stencil screen printing art and more particularly to squeegee mechanisms for applying ink evenly over patterned printing screens.

In manual stencil screen printing in contrast to the high-speed printing, a pattern is designed on a fine fabric screen. The pattern defines which areas ink can or cannot pass through. The screen is securely mounted on a frame of generally rectangular configuration. The fabric to be printed in held tautly beneath the frame and the screen is positioned over the fabric in close contact therewith. The ink is pressed through the screen in accordance with the pattern by a hand-held squeegee which is a relatively rigid, rubber, blade-like element by which the ink is swept across the surface of the screen.

The squeegee is either a separate element which is hand held or which is mechanically connected to the framework by suitable linkages and guide rods permitting movement in predetermined paths over the screen. This invention is directed toward improvements in the latter type of squeegee.

The prior art mechanical squeegees include supporting guide rods which are attached to the framework by suitable mounting means and to which the squeegee is attached. The squeegee generally is permitted to move freely in one direction which is the direction in which the squeegee is facing and which will be termed the "longitudinal" direction herein. However, it is not permitted free movement laterally; that is, in the direction of its longitudinal axis. Usually, the squeegee is locked in a fixed position along the length of its lateral support. Hence when the squeegee is moved in the longitudinal direction, it is limited to a path whose width is substantially equal to the length of the squeegee blade. One of the main advantages of the mechanical arrangements is that the guide rods insure that the squeegee applies a uniform, downward force on the printing screen for a selected path. One of its disadvantages, however, is its limited movement in only a single path as mentioned above, longitudinally, when in operation. It can not effectively "sweep" the ink from the perimeter of the screen to the center since it is prohibited from rotational movement and free lateral movement. Frequently a second, hand-held squeegee, card, scraper, or the like is used in conjunction with a mechanical squeegee to sweep ink from the outer edges of the screen toward the center. This is a messy procedure and ink is quite likely to get on the user's hands and clothes.

It is an object of this invention to provide a mechanical squeegee apparatus which combines the advantages of both the mechanical squeegee and the hand-held squeegee. While the mechanical squeegees of the prior art are faster and much neater than the hand-held squeegee, they can not duplicate the movements of the hand-held squeegee in sweeping the ink from the outer confines of the screen toward the center and into the design area.

It is another objective of this invention to provide a squeegee which can move freely longitudinally and laterally and can be rotated or twisted about a vertical axis to an angular orientation relative to its paths of travel over the screen.

It is a further objective of this invention to provide a squeegee apparatus which can be mounted as a unit on existing printing screen frames.

It is another objective of this invention to provide a squeegee apparatus having a handle attached to the squeegee blade in such a manner that by the operator using one hand only the squeegee can be passed through all of the various movements.

SUMMARY OF THE INVENTION

This invention relates to a device which combines the advantages of the conventional mechanical squeegees and hand-held squeegees known to the prior art, and more particularly the device includes a longitudinal support bar on one side of a printing screen frame, a lateral support bar mounted for free movement on the longitudinal support bar and extending transversely to the longitudinal support bar and over the screen area. A squeegee and a holder therefor are mounted on the lateral support bar for free movement along the length thereof and for limited rotational movement about a vertical axis extending perpendicularly to the longitudinal axis of the support bar. Mounting means are provided for attaching the device to a printing screen.

The means for attaching the blade and holder to the lateral support bar includes a framework comprised of an inverted U-shaped member having a pair of spaced side walls. A handle is attached to the U-shaped member. A pair of upper and lower roller bearings are journaled in the side walls. The upper and lower bearings engage upper and lower surfaces of the support bar and the side walls of the U-shaped member are spaced apart a distance greater than the cross sectional width of the lateral support bar such that the U-shaped member and the squeegee may be twisted or rotated relative to the lateral support bar. The squeegee is further attached to the attachment means by a pivotal connection which permits limited pivotal movement on a horizontal axis such that the squeegee blade is permitted to move to less than a vertical disposition, leaning towards its particular path of travel. In the prior art the handle is usually connected to the lateral bar and not directly to the squeegee blade holder. Hence, the blade had to be locked in a predetermined position relative to the lateral support bar. The handle then was used to move the lateral bar to which the squeegee was attached. Here, the handle is connected directly to the squeegee to move it relative to the lateral support bar.

These and other objects of the invention will become more apparent to those skilled in the art by reference to the following detailed description when viewed in light of the accompanying drawings wherein:

BRIEF DESCRIPTION OF THE DRAWINGS

FIG. 2 is a side view in elevation of the device of FIG. 1;

FIG. 3 is a view taken along the lines 3—3 of FIG. 2; and

DESCRIPTION OF THE INVENTION

Figure 1:
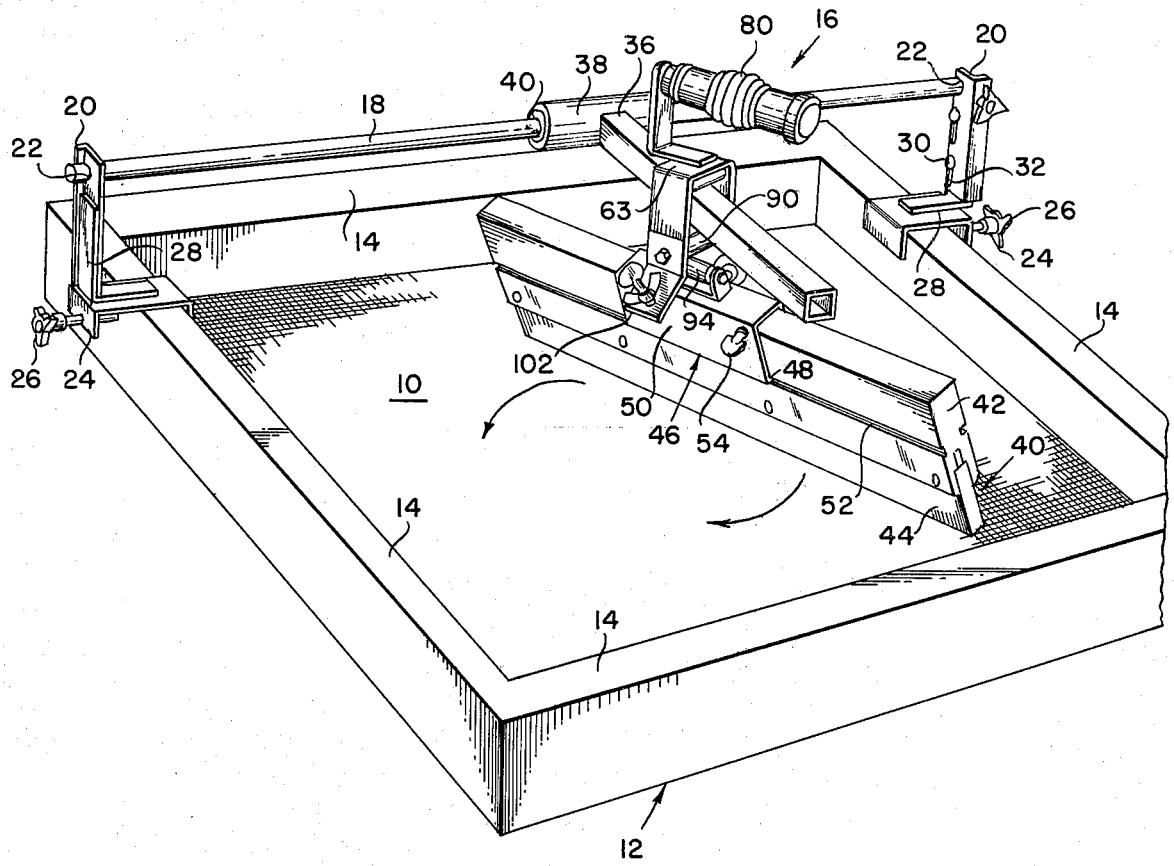
FIG. 1 is a perspective view of the device of this invention mounted on a printing screen frame.

Referring now to the drawings wherein like numerals indicate like parts, a stencil printing screen 10 is stretched taut over a generally rectangular frame 12 which includes side walls 14. As mentioned earlier herein, the screen is patterned to permit ink to flow through various parts of the screen to which a design is to be applied. Ink is deposited onto a screen surface and spread over the screen and through the interstices thereof by means of a squeegee mechanism generally indicated by the numeral 16. The mechanism 16 includes a longitudinal support bar 18 which extends along one side of the frame 12 and which is supported at each end by an upright standard 20. The standards 20 are provided with apertures 22 which receive the ends of bar 18. Clamps 24 are attached to a pair of opposite side walls 14 of the frame 12 and are retained thereon by means of a thumb screw 26. Supporting uprights 28 are affixed to the clamps 24 and are bolted to the standards 20 by means of fasteners 30. Fasteners 30 are received in oblong slots 32 which permit relative vertical movement between the standards 20 and uprights 28 such that the standards 20 and, therefore, the rod 18 can be adjusted to the proper height relative to the screen surface.

Laterally extending bar 36 extends transversely to the longitudinal axis of the bar 18 and out over the patterned area of the screen. The bar 36 is freely movable along the length of the bar 18 and is connected thereto by means of cylindrical bearing 39 which is encased in housing 38.

The longitudinal and lateral support bars 18 and 36 function as supports and guides for two directions of movement os a squeegee 40 which is attached to the bar 36 in a manner now to be described. The squeegee 40 includes a body member 42 and a blade-like rubber member 44, the latter of which engages the upper surface of the screen 10 to spread the ink over the patterned area. A blade holder or clamp 46 tightly grips the body 42 of the squeegee 40 and is retained thereon by the inwardly directed flanges 48 on the lower edges of the side walls 50 which are received in longitudinal grooves 52 in the body 42. A thumb screw 54 is provided to insure tight engagement.

The means for attaching the squeegee to the transverse bar 36 for free movement thereon will now be described. A framework 60, comprising an inverted U-shaped channel member, has upper and lower bearing members 62 and 64 in the form of roller bearings journaled in side walls 66 and 68 thereof. The rollers 62 and 64 engage upper and lower surfaces 70 and 72 respectively of the lateral support bar 36 in the manner best seen in FIG. 4. The spacing between the upper and lower rollers 62 and 64 is such that the bar 36 is snuggly received therein to preclude vertical movement of the squeegee relative to the lateral support bar 36.

The side walls 66 and 68 of the channel member 60, however, are spaced apart a distance greater than the cross sectional width of the lateral bar 36 such that the framework 60 can be twisted or rotated, to a limited extent, about a vertical axis relative to the longitudinal axis of the lateral bar 36. This movement is shown in FIG. 1 and is more clearly seen in FIG. 3 as represented by the arrows. This type movement is not found in conventional prior art mechanical squeegee devices which limit the free movement of the squeegee to a longitudinal or front and back movement. In other words, the squeegee of this invention is mounted for free movement on the bar 36 to simulate the movements of a hand-held squeegee but having the benefits of the support of the lateral and longitudinal bars to afford uniform pressure to the screen. Since the squeegee can be rotated or twisted in a manner shown in the drawings, during operation ink can be swept from the edges of the screen to the patterned area without the need for an intermediary device such as a hand-held card or scraper. The handle 80 is attached to the upper portion 63 of the framework 60 for operational control of the squeegee.

Figure 4:
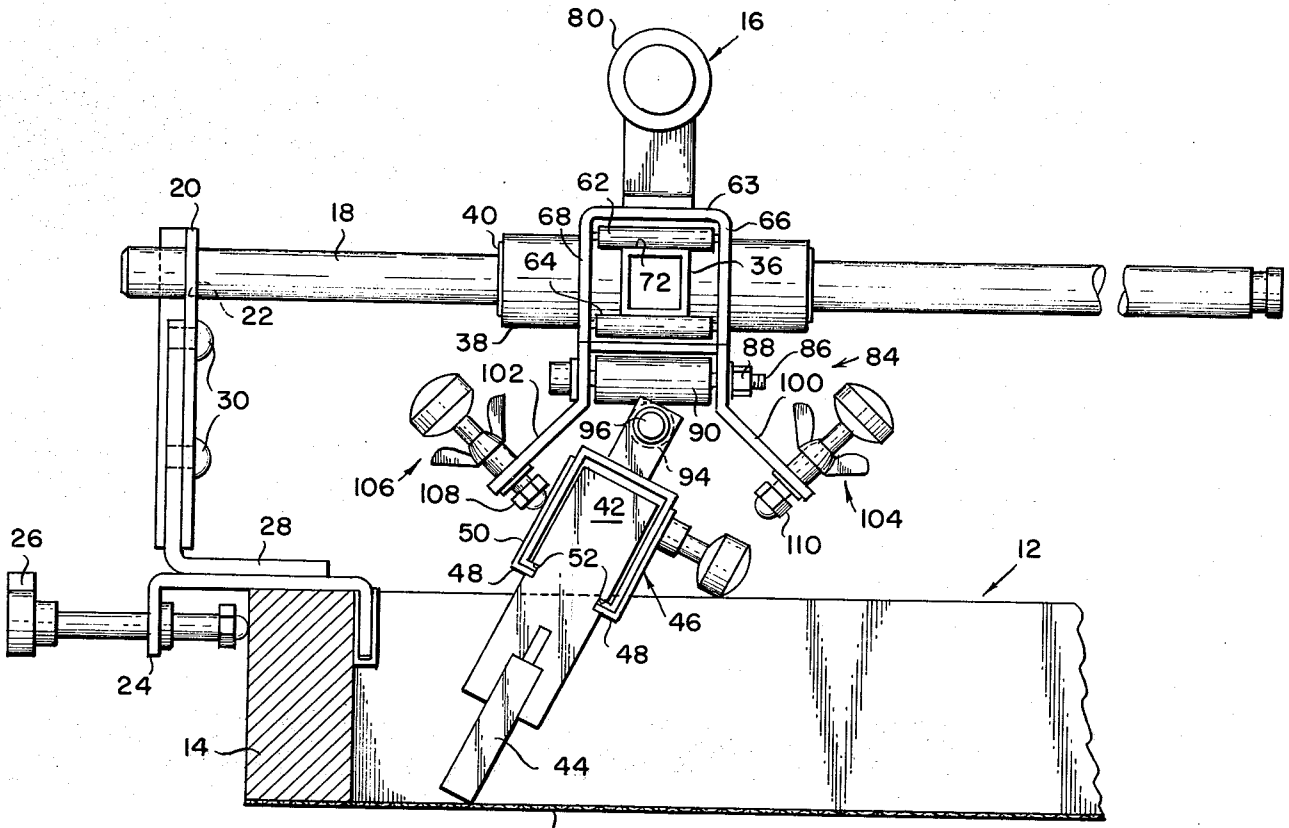
FIG. 4 is a front view in elevation of the device of FIG. 1.

The squeegee 40 is connected to the framework 60 through a pair of transverse, horizontal pivotal connections 82 and 84. The first pivotal connection 84 includes a rod 86 which is received in apertures in extensions of the side walls 68 below the lower bearing member 64. The rod 86 is retained in position by means of a threaded fastener 88. A collar or sleeve 90 is positioned over the rod 86 for rotational movement thereon. Welded or otherwise affixed to the underside of the sleeve 90 and extending in a direction transverse to the sleeve 90 is a pivotal connection 82 comprising a U-shaped member 92 which supports a rod 94. Received over the rod 94 is a sleeve 96 which is rotatably mounted relative to the rod but which is affixed by welding or otherwise to the sleeve 90 of the pivotal connection 84. The result is essentially a universal connection between the squeegee 40 and the means attaching the blade to the lateral bar 36. As best seen in FIGS. 1 and 4, the upper end of the squeegee blade 40 is tilted toward its direction of travel by means of the pivotal connection 82. In that position the squeegee provides the optimum amount of pressure relative to the frictional coefficient between the squeegee and screen and maintains consistency in spreading the ink over the screen.

A pair of flared extensions 100 and 102 extend from the side walls 66 and 68 of the frame 60 and receive stop means 104 and 106 in the form of thumb screws having bumpers 108 and 110. The bumpers, which are adjustable by means of the thumb screws, limit the pivotal movement of the squeegee 40 about the pivotal connection 82.

The squeegee of this invention constitutes an improvement over the prior art by combining the advantages of manual squeegees with those of the heretofore known mechanical squeegees in providing means which permits relative rotational or twisting movement between the squeegee 40 and the laterally extending bar 36, which permits free movement axially of bar 36, and which provides a direct connection between handle 80 and the squeegee. The result is that the operator, by using one hand and without need of an intermediary device, can "sweep" the screen 10 in a series of arc-like movements to move ink from the outer perimeters of the screen toward the center or patterned area.

In a general manner, while there has been disclosed an effective and efficient embodiment of the invention, it should be well understood that the invention is not limited to such embodiment as there might be changes made in the arrangement, disposition, and form of the parts without departing from the principle of the present invention as comprehended within the scope of the accompanying claims.

We claim:

1. A squeegee apparatus for use with a printing screen and frame therefor comprising a longitudinal support mounted on said frame, a lateral support bar mounted for movement longitudinally of said longitudinal support bar and extending transversely to said longitudinal support bar and over said screen, a squeegee blade assembly, comprising a squeegee blade having a longitudinal axis and attaching means for attaching said squeegee blade to said lateral support bar for free movement along said lateral bar and for substantially free rotative movement about an axis extending vertically and perpendicularly to said lateral bar, means attached to said squeegee blade assembly for directly moving said squeegee blade relative to said longitudinal support bar and to said lateral support bar in sweeping movements over said printing screen to force ink therethrough, and mounting means for mounting said squeegee apparatus on said frame.

2. The apparatus of claim 1 including wherein said means for directly moving said squeegee blade comprises a handle affixed to said assembly.

3. The apparatus of claim 1 and including a pivotal connection between said squeegee blade and said attaching means permitting relative pivotal movement between said squeegee blade and said attaching means along an axis parallel to the axis of said squeegee blade.

4. The apparatus of claim 1 wherein attaching means includes a framework, upper and lower bearing elements journaled in said framework, said lateral support bar having upper and lower surfaces engaged by said upper and lower bearing elements.

5. The apparatus of claim 4 wherein said upper and lower bearing elements are roller bearings.

6. The apparatus of claim 5 wherein said framework includes a pair of side walls, said roller bearings being journaled in said side walls, the distance between said side walls being greater than the cross-sectional width of said lateral bar.

7. The apparatus of claim 4 and including a first pivotal connection between said squeegee blade and said attaching means permitting relative pivotal movement between said squeegee blade and said attaching means along an axis parallel to the longitudinal axis of said squeegee blade.

8. The apparatus of claim 7 and including stop means on said attaching means for limiting said pivotal movement between said attaching means and said squeegee blade means.

9. The apparatus of claim 7 and including a second pivotal connection connecting said first pivotal connection to said attaching means, the axis of said second pivotal connection means extending transversely to the axis of said first pivotal connection.

* * * * *